US005478072A

United States Patent [19]

Kanno et al.

[11] Patent Number: 5,478,072

[45] Date of Patent: Dec. 26, 1995

[54] RACKET STRING AND STRINGED RACKETS USING THE SAME

[75] Inventors: Katsuo Kanno, Otsu; Yutaka Takashima, Ashiya, both of Japan

[73] Assignee: Gosen Co., Ltd., Uchi-awaji, Japan

[21] Appl. No.: 287,803

[22] Filed: Aug. 9, 1994

[30] Foreign Application Priority Data

Aug. 10, 1993 [JP] Japan ..... 5-198367

[51] Int. Cl.[6] ..... A63B 51/02

[52] U.S. Cl. ..... 273/73 R

[58] Field of Search ..... 273/73 R, 73 C, 273/73 D; 428/364; 57/200

[56] References Cited

U.S. PATENT DOCUMENTS 4,330,132 5/1982 Ferrari .
5,346,212 9/1994 Kuebler ..... 273/73 R X

FOREIGN PATENT DOCUMENTS 0560015 9/1993 European Pat. Off. .
0602545 6/1994 European Pat. Off. .
3141369 4/1983 Germany ..... 273/73 R
52-16848 4/1976 Japan .
52-16849 4/1976 Japan .
101165 6/1984 Japan ..... 273/73 R
2167310 5/1986 United Kingdom ..... 273/73 D

*Primary Examiner*—Raleigh W. Chiu
*Attorney, Agent, or Firm*—Fish & Richardson

[57] ABSTRACT

A racket string consists of lengthwise sections having different tensile elastic moduli with at least one section of the string having a tensile elastic modulus higher than other sections. A stringed racket includes at least one string constituting the central stringed area of the racket with higher tensile elastic modulus, and a peripheral stringed area with sections of the string having lower tensile elastic modulus. Another stringed racket includes at least one string constituting the central stringed area of the racket with lower tensile elastic modulus and a peripheral stringed area with sections of the string having higher tensile elastic modulus.

10 Claims, 2 Drawing Sheets

RACKET STRING AND STRINGED RACKETS USING THE SAME

FIELD OF THE INVENTION

The invention relates to a string for tennis rackets, badminton rackets, squash rackets and the like, and stringed rackets with such strings. More particularly, the invention relates to a string which has at least one lengthwise section with a tensile elastic modulus higher than other sections, and stringed rackets with such strings.

BACKGROUND OF THE INVENTION

One of the most important concerns in manufacturing a racket is how to enlarge the sweet spot.

The stiffness distribution of the racket head (stringed area) of a racket was observed by measuring the tensile strength of each section of the strings of the stringed racket. According to the measurements, the:central section of the stringed area is macroscopically much stiffer than the peripheral sections. This is thought to be a product of the vertical and horizontal length of a racket frame.

Hitting a ball oil the sweet spot provides an effective elastic rebound of the ball from the racket. However, if a ball is hit on a non-sweet spot area (off-spot area), vibrations and shocks are generated by the hit and a forceful ball cannot be returned.

Since increasing the area of a racket head is effective, the racket head of popular tennis rackets was increased from typically 90 square inches to the current 110 square inches. A tennis racket with a head area as large as 125 square inches is widely used by beginners and the aged. As the area of the racket head is enlarged, the sweet spot area also increases, so that difficult, off-center balls can be easily returned. However, the head area may become too large to play with good control and quick reaction. Thus, there is a limit to making an effective racket simply by enlarging the area of the head.

A tapered string and a stringed racket with such strings, whose central stringed area has a larger string diameter than the peripheral area, are disclosed in Published Unexamined Japanese Utility Models Sho No. 52-16848 and Sho No. 52-16849 by the inventors of this invention.

Professional tennis players who usually hit the ball on the sweet spot have been requesting a sweet spot with a more effective elastic rebound. However, in conventional technologies, it is too costly to manufacture a string which can form such a sweet spot, thus the string is not practical to manufacture.

In order to solve the problems of conventional strings and stringed rackets with such strings, this invention provides a string which can provide a large sweet spot, and a stringed racket with such strings.

Another object of the invention is to provide a string which can improve the solidity of a ball rebounded from the sweet spot of a racket strung with the strings while keeping the solidity of a ball rebounded from a non-sweet spot area to the conventional level, and to provide a stringed racket with such strings.

A third object of the invention is to provide an inexpensive and attractive string which can form a pattern on the stringed area of a stringed racket, and to provide a stringed racket with such strings.

SUMMARY OF THE INVENTION

In order to accomplish the above and other objects and advantages, the invention provides a string consisting of lengthwise sections with different tensile elastic moduli. At least one lengthwise section of the string has a tensile elastic modulus higher than other sections of the string.

It is preferable that the difference in tensile elastic modulus between at least one lengthwise section having a higher tensile elastic modulus and other sections with lower tensile elastic modulus is at least 5%.

It is preferable that at least one lengthwise section of the string having a tensile elastic modulus higher than other sections of the string is made visually distinguishable from the other sections by at least one method selected from the group consisting of dyeing, decoloring and coloring.

It is preferable that at least one lengthwise section of the string having a tensile elastic modulus higher than other sections of the string has a lower ductility than the other sections of the string.

The invention also provides a stringed racket using at least one string. The string has lengthwise sections, and at least one section of the lengthwise sections has a tensile elastic modulus higher than other sections. At least one section having a tensile elastic modulus higher than the other sections constitutes the central stringed area of the stringed racket while the other sections having a tensile elastic modulus lower than at least one section of the string constitutes the peripheral stringed area of the racket.

It is preferable that the stringed racket uses a vertical string and a horizontal string, that each one of the vertical string and the horizontal string has three lengthwise sections with the central lengthwise section having a tensile elastic modulus higher than two end sections, and that the central lengthwise section constitutes the central stringed area of the stringed racket while the two end sections having a tensile elastic modulus lower than the central lengthwise section constitutes the peripheral stringed area of the racket.

It is preferable that the central stringed area is made visually distinguishable from the peripherial stringed area by at least one method selected from the group consisting of dyeing, decoloring and coloring.

The invention also provides a stringed racket using at least one string. The string has lengthwise sections, and at least one lengthwise section has a tensile elastic modulus lower than other sections. At least one section having a tensile elastic modulus lower than the other sections constitutes the central stringed area of the stringed racket while the other sections of the string having a tensile elastic modulus higher than at least one section consitute the peripheral stringed area of the stringed racket.

It is preferable that the stringed racket uses a vertical string and a horizontal string, that each one of the vertical string and the horizontal string has three lengthwise sections with the central lengthwise section having a tensile elastic modulus lower than two end sections, and that the central lengthwise section constitutes the central stringed area of the stringed racket while the two end sections having a tensile elastic modulus higher than the central lengthwise section constitutes the peripheral stringed area of the racket.

It is preferable that the peripheral stringed area is made visually distinguishable from the central stringed area by at least one method selected from the group consisting of dyeing, decoloring and coloring.

It is also preferable that the central stringed area is a sweet spot, and that the peripheral stringed area is a non-sweet spot area.

DETAILED DESCRIPTION OF THE INVENTION

Figure 1:
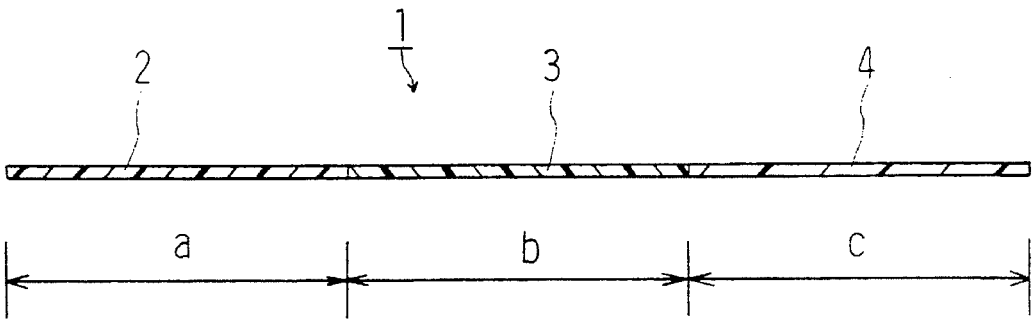
FIG. 1 is a cross-sectional view taken in the longitudinal direction of a string of one embodiment of the invention.

Since the string of the invention has at least one lengthwise section of tensile elastic modulus higher than other sections, the area of the central stringed area of a racket strung with such strings can be enlarged so as to improve the solidity, or control and power, of the rebound of a ball from anywhere on the racket. A racket strung with the string of the invention, moreover, can improve the solidity of the rebound from the central stringed area while keeping the solidity of a hit on the peripheral stringed area to a conventional level. In addition, it is not costly to manufacture the string of the invention.

At least one lengthwise section of a string having a tensile elastic modulus higher than other sections constitutes the central stringed area of a racket of the invention, so that a solid ball can rebound from the central stringed area as well as from the peripheral stringed area of the racket. In other words, a ball rebounds well from anywhere on the stringed area of the racket, and the area of the sweet spot is enlarged. The difference in tensile elastic modulus between at least one lengthwise section of the string and the other sections should be at least 5%.

On the other hand, if at least one lengthwise section of a string having a tensile elastic modulus lower than other sections constitutes the central stringed area (sweet spot) of a stringed racket of the invention, the solidity of the rebound of the ball from the area is improved while keeping the solidity of the rebound from a peripheral stringed area (non-sweet spot area) to the conventional level. Thus, this stringed racket is suitable for professional tennis players.

When at least one lengthwise section of the string of the invention having a tensile elastic modulus higher than other sections is made visually distinguishable from the other sections by dyeing, decloring or coloring, a beautiful pattern is formed on the stringed area of a racket with such strings.

The area of the sweet spot is enlarged so as to improve the solidity of a ball rebounded from a racket, when the ductility of at least one lengthwise section of the string with a tensile elastic modulus higher than other sections is lower than the ductility of the other lengthwise sections of the string. The difference in tensile elastic modulus between the one lengthwise section of the string and the other sections should be at least 5%.

In one stringed racket of the invention, at least one section of a string with a tensile elastic modulus higher than other sections constitutes the central stringed area of the racket. Thus, the area of the sweet spot is enlarged so as to improve the solidity of a ball rebounded from anywhere on the racket. The difference in tensile elastic modulus between the section having a higher tensile elastic modulus and sections with lower tensile elastic modulus should be at least 5%.

At least one section of a string having a tensile elastic modulus lower than other sections constitutes the central stringed area (sweet spot) of another stringed racket of the invention, so that the solidity of the rebound of the ball from the area is increased while keeping the solidity of the rebound of the ball from a peripheral stringed area (non-sweet spot area) to a conventional level. This stringed racket is especially suitable for professional tennis players.

When the non-sweet spot area is made visually distinguishable from the sweet spot by dyeing, decloring or coloring, the stringed racket has a beautiful pattern on the stringed area of the racket.

The invention is now specifically explained by referring to the following examples. The examples are illustrative and should not be construed as limiting the invention in any way.

In the following examples of the invention, the tensile elastic modulus is calculated from an initial tangent modulus (JIS L1013-1981). More specifically, tensile elastic modulus is calculated from the diameter of a sample string and the angle of a line tangent to the load-elongation curve of the string at 30 kg. The 30 kg load is chosen in the calculation so as to reflect the actual conditions of the string of a stringed racket. In addition, ductility is calculated from the elongation percentage of the sample string or the elongation of the string after being ruptured (JIS L10313-1981).

The stringed racket of the invention for beginners and the aged has a peripheral stringed area consisting of the sections of at least one string with tensile elastic modulus lower than the section of the string constituting the central stringed section. In contrast, the racket of the invention for professional tennis players has a peripherial stringed area (non-sweet spot area) consisting of the sections of at least one string with a tensile elastic modulus higher than the section of the string constituting a central stringed area (sweet spot).

FIG. 1 is a cross sectional view taken in the longitudinal direction of a string of one embodiment of the invention. In FIG. 1, 2 is a section of a string 1 having a relatively lower tensile, elastic modulus than a section 3, and a section 4 of the string also has a relatively lower tensile elastic modulus than section 3. The length of sections 2, 3 and 4 is about 2.33 m, so that the entire length of string 1 is about 7 m. A racket is strung with these 7 m strings vertically and horizontally. Sections 2, 3 and 4 can be made distinguishable from each other by coloring, decoloring or dyeing, or the color of these sections can be the same.

An about 14 m long string is prepared by continuously forming a 7 m long string consisting of sections 2, 3 and 4 to the end of section 4 of the 7 m long string. Before a racket is strung with the 14 m long string, the string is cut into two parts. A racket is then strung with the strings in the same ways as the 7 m long strings.

Figure 2:
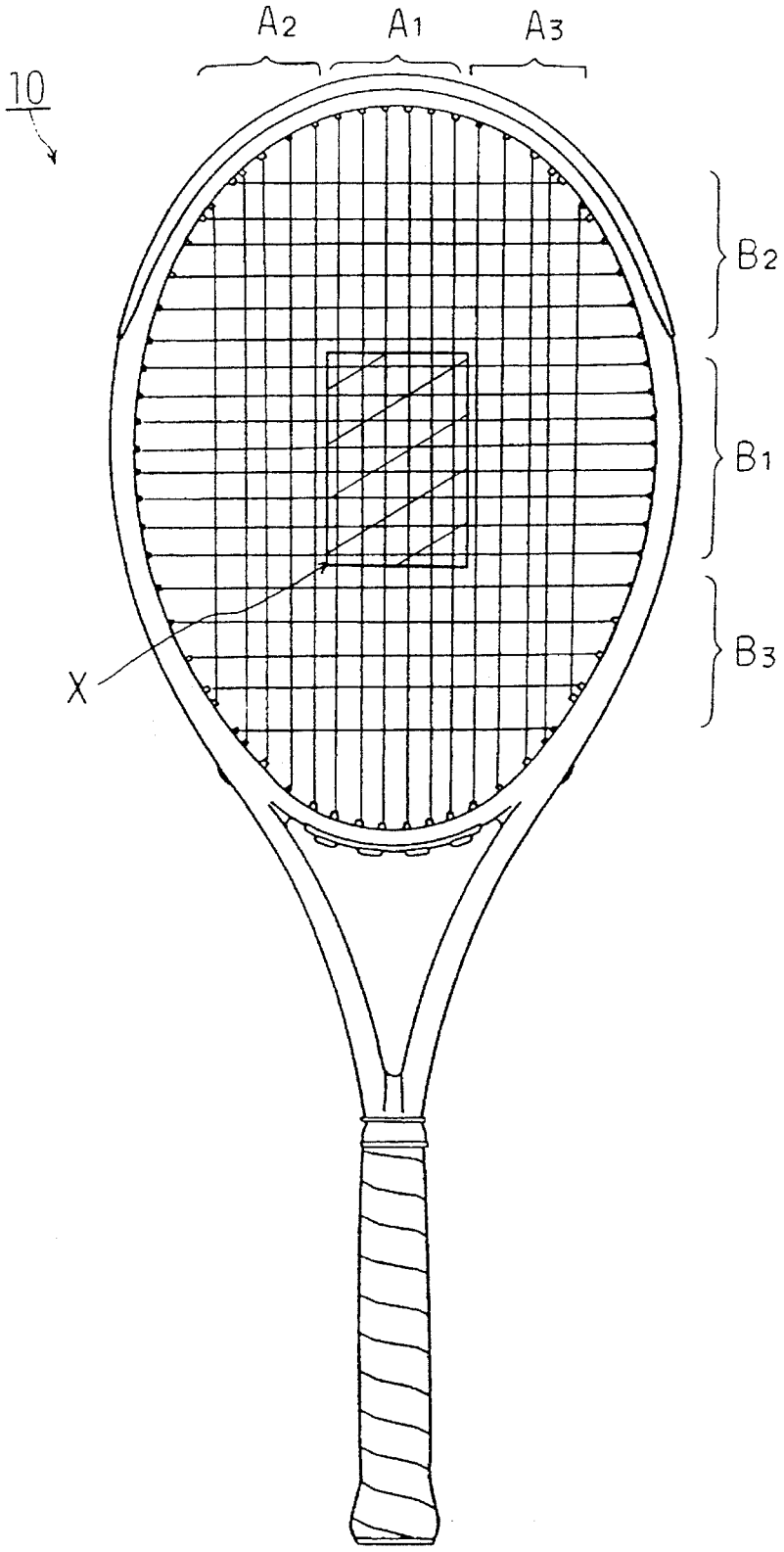
FIG. 2 is a front view of a racket of one embodiment of the invention.

In FIG. 2, 10 is a stringed racket, and X is the central stringed area of the racket. The stringed area except area X is a peripherial stringed area. Vertical section $A_1$ of the stringed area of racket 10 consists of section 3 of string 1; vertical section $A_2$ consists of section 2 of string 1; vertical section $A_3$ consists of section 4 of string 1. Horizontal section $B_1$, on the other hand, consists of section 3 of string 1; horizontal section $B_2$ consists of section 2 of string 1; horizontal section $B_3$ consists of section 4 of string 1. The sections of strings with relatively lower tensile elastic modulus constitute the peripherial stringed area of stringed racket 10, so that a solid ball can be returned even if a ball is rebounded from the peripherial stringed area. Thus, the sweet spot of stringed racket 10 is enlarged, and the racket is suitable for beginners and the aged.

In another embodiment, the sections of strings with a tensile elastic modulus higher than the central section constitute the peripheral stringed area (non-sweet spot area) of a racket while the central section of the strings having a tensile elastic modulus lower than the sections constitutes the central stringed area (sweet spot), so that the solidity of the rebound of a ball from the central stringed area of the racket is increased. In other words, this racket is suitable for professional tennis players.

By distinguishing a color for each section $A_1$, $A_2$, $A_3$, $B_1$, $B_2$ and $B_3$, a colorful pattern with six different colors is formed on the stringed area of stringed racket 10.

The tensile elastic modulus of a string is adjusted by a free heat treatment (relaxation heat treatment or relax heat treatment), or a heat treatment on a string which is in little tension. The heat treatment can be either a wet heat treatment such as with hot water or vapor, or a dry heat treatment. As shown in the following table, the tensile elastic modulus of a nylon string having a 369 kg/mm$^2$ tensile elastic modulus before heat treatment declined after the treatment.

TABLE

| Treatment | tensile elastic modulus |
|---|---|
| Boiling water (at 98° C.) for 15 minutes | 279 kg/mm$^2$ |
| Dry heat (at 150° C.) for 3 minutes | 174 kg/mm$^2$ |

A racket is strung with strings having lengthwise sections of different tensile elastic moduli by:

preparing an about 6.5–7.0 meter long string as a vertical string (main string) and a horizontal string (cross string);

applying heat treatment on about 2.33 m long end sections of the strings; and stringing a racket with the vertical and horizontal strings while placing the central section of the strings on the central section of the racket head, and stringing outward from the central section.

Thus, as shown in FIG. 2, the sections of the strings with low tensile elastic modulus (the sections where the heat treatment was directed) constitute the peripheral stringed area of the stringed racket. When the string is made of nylon, dyeing agents such as dye, acid and the like can be added to boiling water, so that the string can be dyed at the same time as treated with heat.

By coloring only the sections of strings treated with heat, an interesting pattern and design can be formed on the string area of a racket. The color of the vertical string and the horizontal string can also be differentiated so as to form an interesting pattern and design on the stringed area.

EXAMPLE 1

A nylon string was prepared in the following steps:

twisting twenty-five gut strings having a 0.115 mm diameter around a core yarn having a 1.00 mm diameter; and coating the twisted strings with heat-melting nylon.

The nylon string had a 369 kg/mm$^2$ tensile elastic modulus, 1.289 mm diameter, 80.5 kg tensile strength, 42.9 kg knot strength and 31.2% elongation at the point rupture. The 13.5 m long string was cut into a 7.0 m long vertical string and a 6.5 m long horizontal string.

2.33 m long end sections of the vertical string and 2.25 m long end sections of the horizontal string were treated and colored at the same time by heat treatment. The central section of the vertical string and horizontal string was not treated with heat. As a result, only the sections of the strings treated with heat had a beautiful red color. The heat treatment was carried out with 98° C. hot water, containing a dye (Kayanol Millinng Red RS manufactured by NIPPON KAYAKU CO., LTD.: 3.0% o.w.f. (on the weight of the fiber)) and 0.5 g/liter acetic acid at a liquor ratio 1:100, for 15 minutes. The red colored sections had a 279 kg/mm$^2$ tensile elastic modulus, 1.324 mm diameter, 76.7 kg tensile strength, 42.6 kg knot strength and 38.3% elongation at the point rupture.

A racket was then strung with the vertical string from the central section of the racket head to the ends of the racket head. Similarly, the racket was strung with the horizontal string. As a result, four corners of the stringed area of the racket of this example had a beautiful red color; the sections on the top, bottom, right and left side of the central stringed area of the racket had a mix of red and white (close to transparency) strings; the central stringed area had a white color (close to transparency). The string and stringed racket of this example proved to be excellent, since a ball rebounded easily not only from the central stringed area of the racket but also from the peripheral stringed area. A ball was also returned much more easily from the peripheral stringed area of the racket using the strings of this example than from the off-center stringed area of a racket strung with conventional strings, which were strung in the same ways as the strings of the example but were not sectionally treated with heat. In other words, the sweet spot of the stringed racket of this example was larger than the sweet spot of the stringed racket with conventional strings.

EXAMPLE 2

The same string as of Example 1 was used in this example. The string was then cut into a 7.0 m long vertical string and a 6.5 m long horizontal string. The 2.33 m long central section of the vertical string and the 2.0 m long central section of the horizontal string were treated and colored at the same time by heat treatment. Different from Example 1, the end sections of the vertical and horizontal string were not treated with heat. The same heat treatment as of Example 1 was applied in this example.

A ball rebounded from the central stringed area (sweet spot) of a racket using the strings of this example was solid and forceful, so that the string and stringed racket of this example is significantly useful for professional tennis players. The solidity of a ball's rebound from the peripheral stringed area (non-sweet spot area), however, was at the conventional level.

The string of the invention is not limited to tennis rackets, and can be used for badminton rackets, squash rackets and the like.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes which come within the meaning and range of equivalency of the claims are intended to be embraced therein.

We claim:

1. A racket string comprising lengthwise sections having different tensile elastic moduli, wherein at least one section of the string has a tensile elastic modulus at least 5% higher than other sections of said string.

2. The racket string according to claim 1, wherein the at least one section of the string having a tensile elastic modulus higher than other sections of said string is made visually distinguishable from said other sections by at least one method selected from the group consisting of dyeing, decoloring and coloring.

3. The racket string according to claim 1, wherein the at least one section of the string having a tensile elastic modulus higher than other sections of said string has a lower ductility than said other sections.

4. A stringed racket comprising at least one string, said string comprising lengthwise sections with at least one of said lengthwise sections having a tensile elastic modulus higher than other sections, wherein the at least one section having a tensile elastic modulus higher than the other sections constitutes a central stringed area of said racket, and wherein the other sections having a tensile elastic modulus lower than the at least one section constitute a peripheral stringed area of said stringed racket.

5. The stringed racket according to claim 4, wherein said stringed racket comprises a vertical string and a horizontal string, wherein each one of said vertical string and said horizontal string comprises three lengthwise sections with a central lengthwise section having a tensile elastic modulus higher than two end sections, wherein the central lengthwise section constitutes a central stringed area of said stringed racket, and wherein the two end sections having a tensile elastic modulus lower than said central lengthwise section constitutes a peripheral stringed area of said stringed racket.

6. The stringed racket according to claim 4, wherein the central stringed area is made visually distinguishable from the peripheral stringed area by at least one method selected from the group consisting of dyeing, decoloring and coloring.

7. A stringed racket comprising at least one string, said string comprising lengthwise sections with at least one of said lengthwise sections having a tensile elastic modulus lower than other sections, wherein the at least one section having a tensile elastic modulus lower than the other sections constitutes a central stringed area of said stringed racket, and wherein the other sections having a tensile elastic modulus higher than the at least one section constitute a peripheral stringed area of said stringed racket.

8. The stringed racket according to claim 7, wherein said stringed racket comprises a vertical string and a horizontal string, wherein each one of said vertical string and said horizontal string comprises three lengthwise sections with a central lengthwise sections having a tensile elastic modulus lower than two end sections, wherein the central lengthwise section constitutes a central stringed area of said stringed racket, and wherein the two end sections having a tensile elastic modulus higher than the central lengthwise section constitutes a peripheral stringed area of said stringed racket.

9. The stringed racket according to claim 7, wherein the central stringed area is made visually distinguishable from the peripheral stringed area by at least one method selected from the group consisting of dyeing, decoloring and coloring.

10. The stringed racket according to claim 7, wherein the central stringed area is a sweet spot, and wherein the peripheral stringed area is a non-sweet spot area.

* * * * *